United States Patent [19]

Scheerhorn

[11] Patent Number: 4,457,569

[45] Date of Patent: Jul. 3, 1984

[54] LOCK ARRANGEMENT FOR OFFICE FURNITURE UNITS

[75] Inventor: Douglas Scheerhorn, Grand Rapids, Mich.

[73] Assignee: Steelcase Inc., Grand Rapids, Mich.

[21] Appl. No.: 362,454

[22] Filed: Mar. 26, 1982

[51] Int. Cl.[3] ..... E05B 65/46

[52] U.S. Cl. ..... 312/219; 312/217; 312/215

[58] Field of Search ..... 312/215, 217, 216, 222, 312/107.5, 219; 70/DIG. 57

[56] References Cited

U.S. PATENT DOCUMENTS

| | | | |
|---|---|---|---|
| 1,109,086 | 9/1914 | Stuck | 312/107.5 |
| 3,123,417 | 3/1964 | Bullock | 312/221 |
| 3,360,318 | 12/1967 | Studinski | 312/217 |
| 3,385,642 | 5/1968 | Schreyer | 312/195 |
| 3,521,937 | 7/1970 | Buhrmaster et al. | 312/217 |
| 3,764,190 | 10/1973 | Anderson | 312/286 |
| 3,857,621 | 12/1974 | Scheerhorn et al. | 312/219 |
| 4,010,989 | 3/1977 | Klug | 312/215 |
| 4,057,307 | 11/1977 | Scheerhorn | 312/219 |
| 4,092,056 | 5/1978 | Signore et al. | 312/219 |
| 4,202,587 | 5/1980 | Wieland | 312/219 |

*Primary Examiner*—William E. Lyddane
*Assistant Examiner*—Joseph Falk
*Attorney, Agent, or Firm*—Price, Heneveld, Huizenga & Cooper

[57] ABSTRACT

A lock arrangement is provided for office furniture units, such as desks, credenzas and the like, that include one or more pedestals defining at least one closable compartment in the nature of a drawer, a cabinet, et cetera, having a mechanism to lock the compartment closed, and a top extending the length of the unit. The lock arrangement is particularly adapted for in-top installations, and comprises a primary lock mounted in the top, and a channel which opens downwardly from the lower surface of the top adjacent the forward edge thereof. A connector device is mounted within the channel, and mechanically interconnects the primary lock with the compartment lock mechanism, such that manipulation of the primary lock locks and unlocks the compartment. A removable cover assembly encloses the channel, and preferably comprises two covers which are positioned over opposite ends of the channel. The end covers have oppositely oriented slide latches, whereby longitudinal divergence of the end covers detachably fastens the same to the channel. A third cover is inserted between the interior ends of the end covers to enclose the medial portion of the channel and prevent convergence of the end covers from the locked position. A lock mechanism retains the center cover in the locked position, and is preferably connected with the primary lock, such that shifting the primary lock also locks and unlocks the center cover to permit only authorized access to the lock arrangement.

75 Claims, 16 Drawing Figures

LOCK ARRANGEMENT FOR OFFICE FURNITURE UNITS

CROSS REFERENCE TO RELATED APPLICATIONS

The present application is related to my copending, U.S. patent application Ser. No. 362,452, filed, Mar. 26, 1982, entitled OVER-CENTERED LOCK ARRANGEMENT FOR OFFICE FURNITURE UNITS, which is hereby incorporated by reference.

BACKGROUND OF THE INVENTION

The present invention relates to office furniture units, such as desks, credenzas and the like, in particular to an improved lock arrangement therefor.

Lock arrangements for desks, credenzas and other similar office furniture units and/or work stations are generally known in the art. Some lock arrangements, of the type disclosed in U.S. Pat. No. 3,123,417, are mounted in the center drawer of the furniture unit. Locks have also been mounted in the front of the unit, directly below the top, as disclosed in U.S. Pat. No. 3,521,937. Concealed lock arrangements, such as those disclosed in U.S. Pat. Nos. 3,385,642; 4,057,307 and 3,360,318 are mounted within the top of the unit to provide a compact, low-profile structure, and are referred to herein as "in-top" locks.

Heretofore, in-top locks, and other similar lock arrangements for office furniture units have been rather difficult to access, such as for repairing or replacing worn or broken parts. For example, in my prior in-top lock arrangement, as disclosed in U.S. Pat. No. 4,057,307, a one-piece cover encloses the primary lock and link members. Removable fasteners secure the cover to the bottom surface of the top. The fasteners are positioned directly above the pedestals, to prevent tampering. However, in the event that the work station does not call for two pedestals underneath the top, at least some of the cover fasteners are exposed. Further, to access the lock area, the top of the desk or credenza must be removed from the pedestals, and disassembled. This is a rather difficult, time consuming task, which requires a relatively skilled mechanic, and involves somewhat heavy lifting.

In large office furniture systems, it is quite beneficial to provide lock arrangements which can be easily removed and replaced. This feature not only facilitates repair and maintenance of the furniture units, but is particularly important in "rekeying" to maintaining proper office security. Changing personnel and duties, as well as office reorganization, demand that the furniture locks be changed rather frequently, particularly in those areas of the office system in which confidential and/or sensitive materials are kept. The practice of changing individual lock tumblers and mating keys is very complicated and costly, and requires the services of a skilled locksmith.

Prior lock arrangements have also been somewhat susceptible to tampering and/or surreptitious entry. In those lock systems which operate with a fore-to-aft locking motion, considerble leverage can be applied to the lock by a screwdriver, or other similar tool, in an attempt to gain entry to the furniture unit. Although lock systems which operate with a side-to-side locking motion are generally considered to be more secure, prying forces which are applied to the lock assembly often result in substantial damage to the lock.

SUMMARY OF THE INVENTION

One aspect of the present invention is an improved, removable cover assembly, which is particularly adapted for in-top locks, and other similar lock arrangements. The cover assembly comprises two covers positioned over opposite ends of a lock channel, with oppositely oriented slide latches, whereby longitudinal divergence of the end covers detachably fastens the same to the channel. A third cover is inserted between the interior ends of the end covers to enclose a medial portion of the channel, and prevent convergence of the end covers toward the unlocked position. An internally mounted lock mechanism retains the center cover in place in the locked position, and is selectively unlocked to permit only authorized access to the lock arrangement. Preferably, the primary lock is detachably mounted to the top by fasteners which are accessible only through the channel, and the center cover is disposed directly below the center lock, whereby the primary lock can be easily removed and replaced by relatively unskilled personnel to change the lock for either repair or security reasons.

Another aspect of the present invention is a lock arrangement having a channel access opening, and mating cover to remove and replace the primary lock. A cover lock attaches the cover to the channel to prvent surreptitious entry, and is operably connected with the primary lock, such that shifting the primary lock also locks and unlocks the cover to permit only authorized access to the lock arrangement. In those embodiments in which the lock comprises a key lock, only those persons having a key can accesss the lock arrangement.

Yet another aspect of the present invention is a center drawer adapter, having an actuator arm attached to the primary lock, so that shifting the primary lock between the locked and unlocked positions also locks and unlocks the center drawer.

The principal objects of the present invention are to provide a lock arrangement having a removable cover assembly which provides easy access to the internally mounted parts of the lock assembly. The cover assembly is particularly designed for in-top locks, and other similar lock arrangements, and preferably comprises a three-piece assembly, having a center cover disposed directly below the primary lock to access the same without detaching the pedestals. The primary lock is detachably mounted in the top, so that it can be easily removed and replaced by even relatively unskilled personnel when required for repair and/or security purposes. The primary lock is operably connected with the pedestal locks and the cover lock, such that manipulation of the primary lock automatically locks and unlocks both the compartments and the center cover. The locking cover arrangement greatly alleviates the hazard of surreptitious entry, yet provides easy access to authorized personnel. The lock arrangement has a very compact, lightweight construction which is quite durable. The top has a very sturdy construction, provides ample room to house an in-top lock arrangment, and requires less material to manufacture. The lock arrangement is efficient in use, economical to manufacture, capable of a long operating life, and particularly well adapted for the proposed use.

These and other features, advantages and objects of the present invention will be further understood and appreciated by those skilled in the art by reference to the following written specification, claims and appended drawings.

DETAILED DESCRIPTION OF THE PREFERRED EMBODIMENTS

Figure 1:
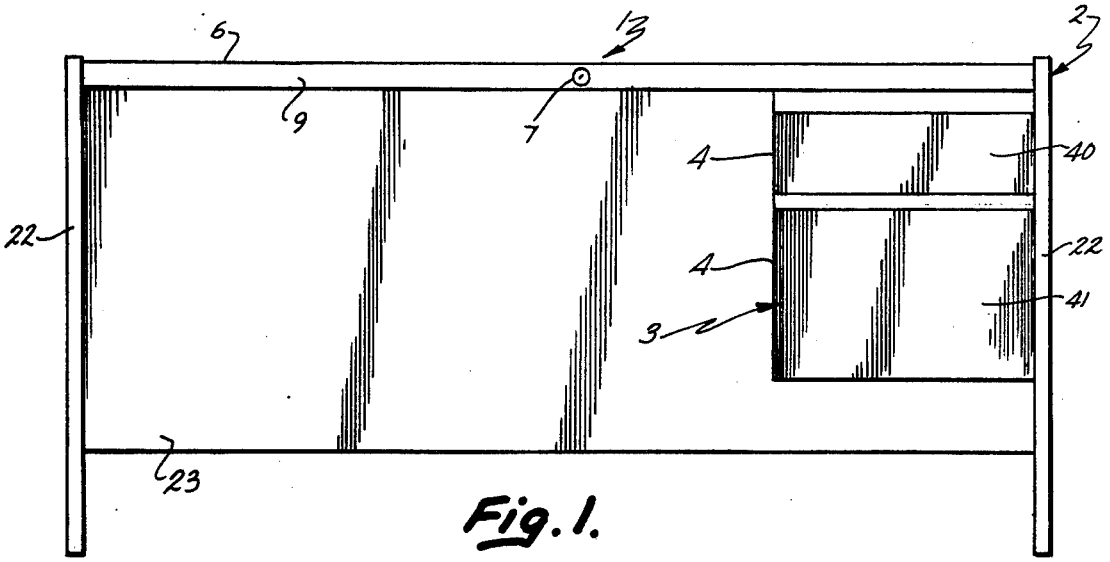
FIG. 1 is a front elevational view of an office furniture unit having a lock arrangement mounted therein embodying the present invention.
Figure 4:
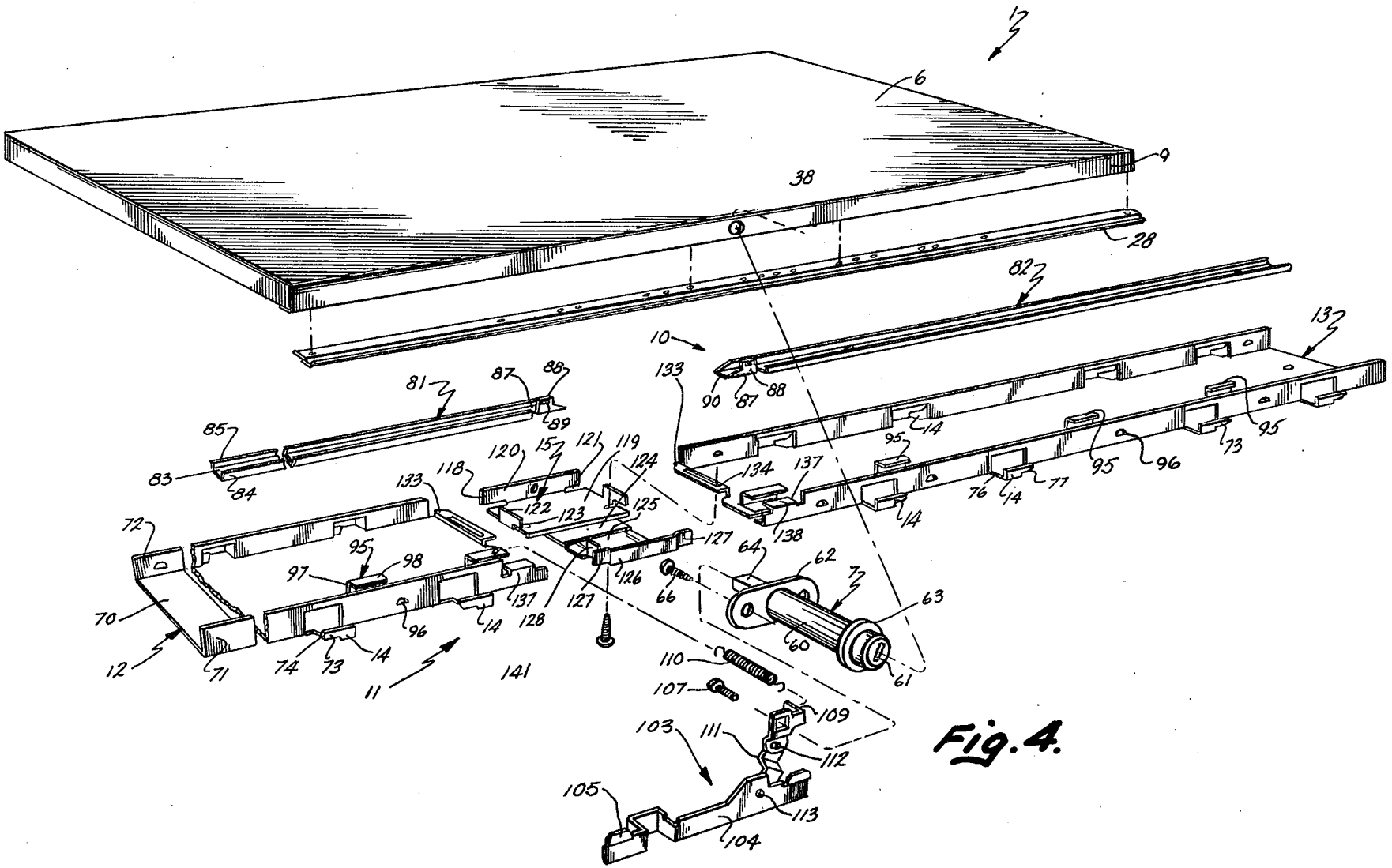
FIG. 4 is an exploded, perspective view of the lock arrangement.
Figure 5:
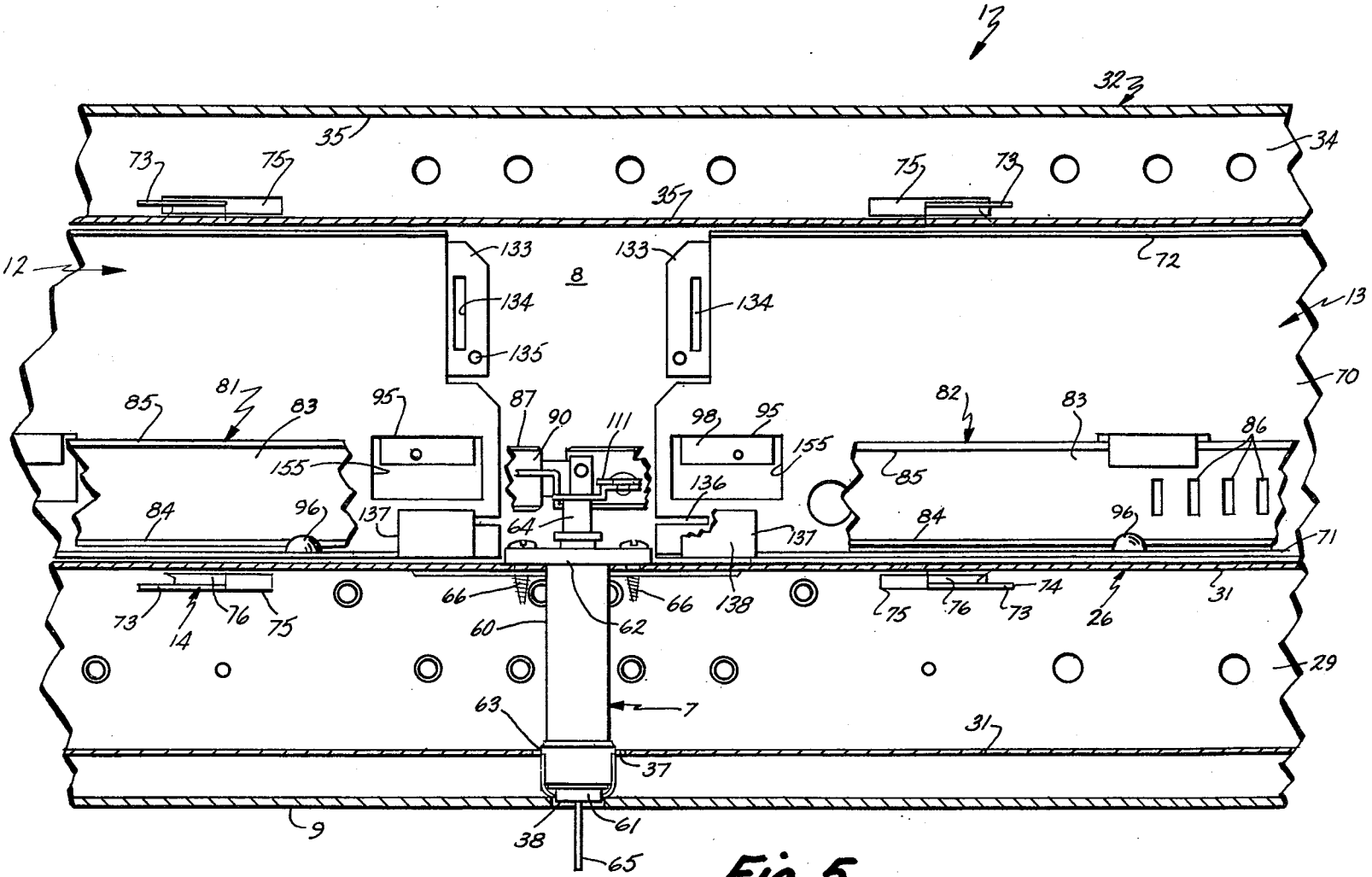
FIG. 5 is a fragmentary, horizontal cross-sectional view of the top of the office furniture unit, particularly showing the lock arrangement, with a center cover removed, and portions of the lock broken away.

For purposes of description herein, the terms "upper," "lower," "right," "left," "rear," "front," "vertical," "horizontal," and derivatives thereof shall relate to the invention as oriented in FIGS. 1, 4 and 5. However, it is to be understood that the invention may assume various alternative orientations, except where expressly specified to the contrary.

The reference numeral 1 (FIG. 1) generally designates a lock arrangement for office furniture units 2, such as desks, credenzas and the like, that include one or more pedestals 3 defining at least one closable compartment 4 in the nature of a drawer, a cabinet et cetera, having a lock mechanism 5, and a top 6 extending the length of unit 2. Lock arrangement 1 comprises a primary lock 7 mounted in top 6, and a channel 8 (FIG. 6), which opens downwardly from the lower surface of top 6, adjacent the forward edge 9 thereof. A connector device 10 is mounted in channel 8, and mechanically interconnects primary lock 7 with compartment lock 5, such that manipulation of primary lock 7 locks and unlocks the compartment 4. A removable cover assembly 11 (FIG. 11) encloses channel 8, and preferably comprises first and second covers 12 and 13, which are positioned over opposite ends of channel 8. The end covers 12 and 13 have oppositely oriented slide latches 14, whereby longitudinal divergence of end covers 12 and 13 detachably fastens the same to channel 8. A third cover 15 is inserted between the interior ends of covers 12 and 13 to enclose the center portion of channel 8, and prevent convergence of end covers 12 and 13 toward the unlocked position. An internally mounted lock mechanism 16 retains center cover 15 in the locked position, and is preferably connected with primary lock 7, such that shifting primary lock 7 also locks and unlocks center cover 15 to permit only authorized access to the lock arrangement.

Lock arrangement 1 is particularly adapted for use in conjunction with in-top lock assemblies, as illustrated and described herein. However, it is to be understood that lock arrangement 1 can be used in other similar applications, including the below-top installation disclosed in U.S. Pat. No. 3,521,937.

Figure 6:
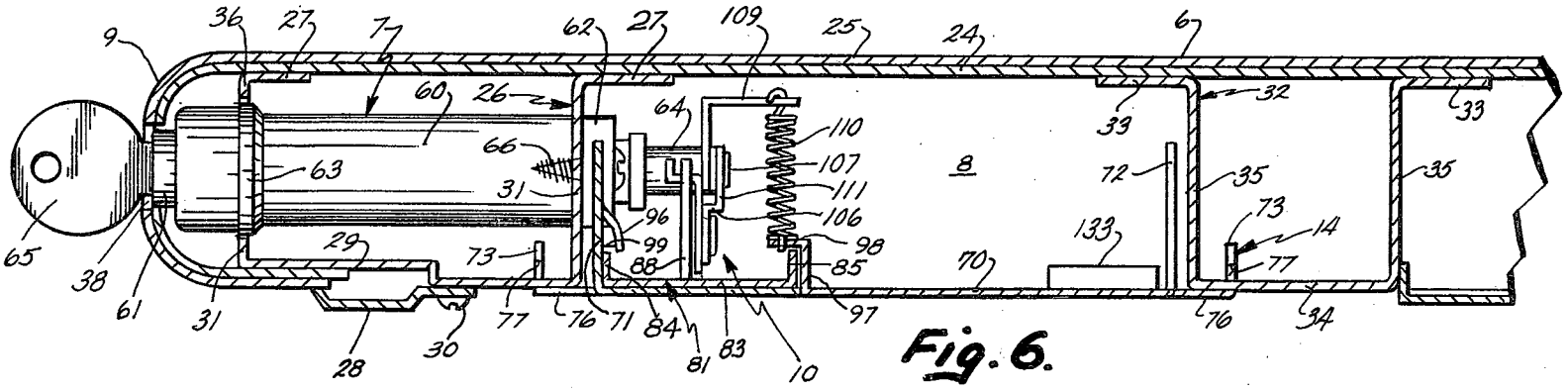
FIG. 6 is a fragmentary, vertical cross-sectional view of the lock arrangement.
Figure 11:
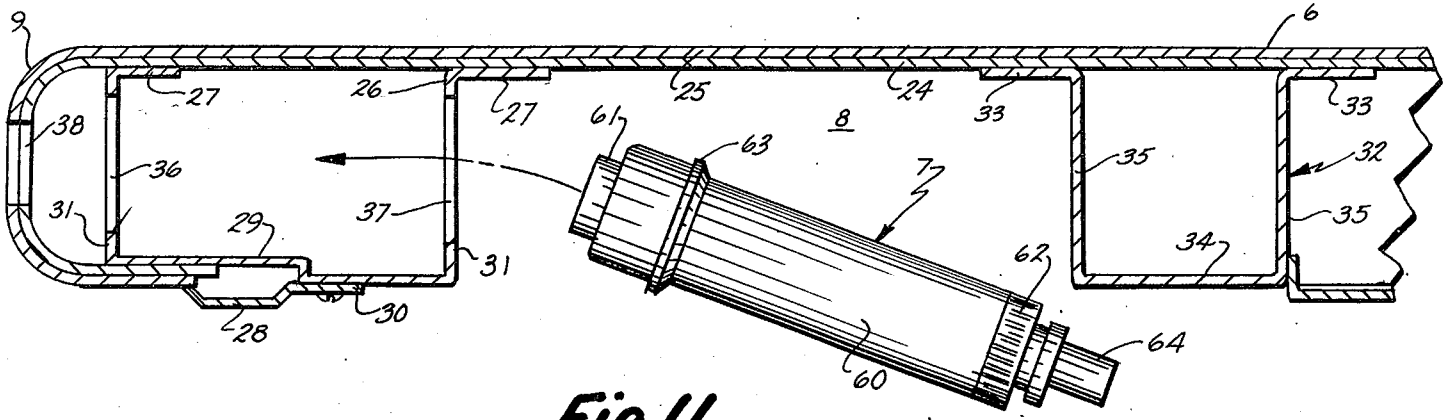
FIG. 11 is a fragmentary, vertical cross-sectional view of the lock arrangement, with the primary lock shown removed from the top.
Figure 13:
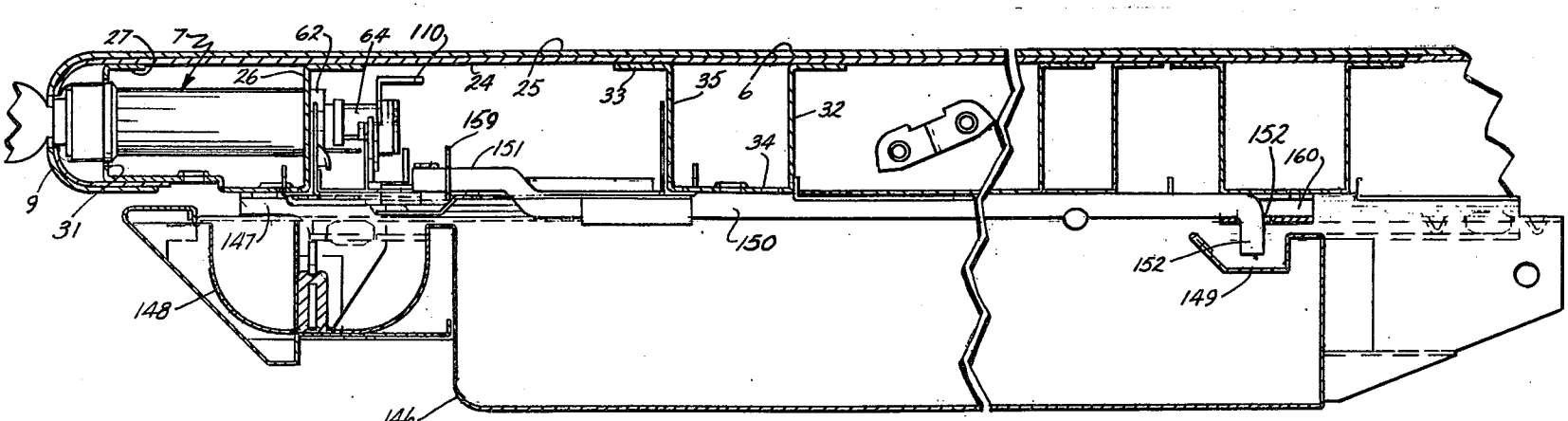
FIG. 13 is a vertical cross-sectional view of the center drawer lock arrangement.
Figure 12:
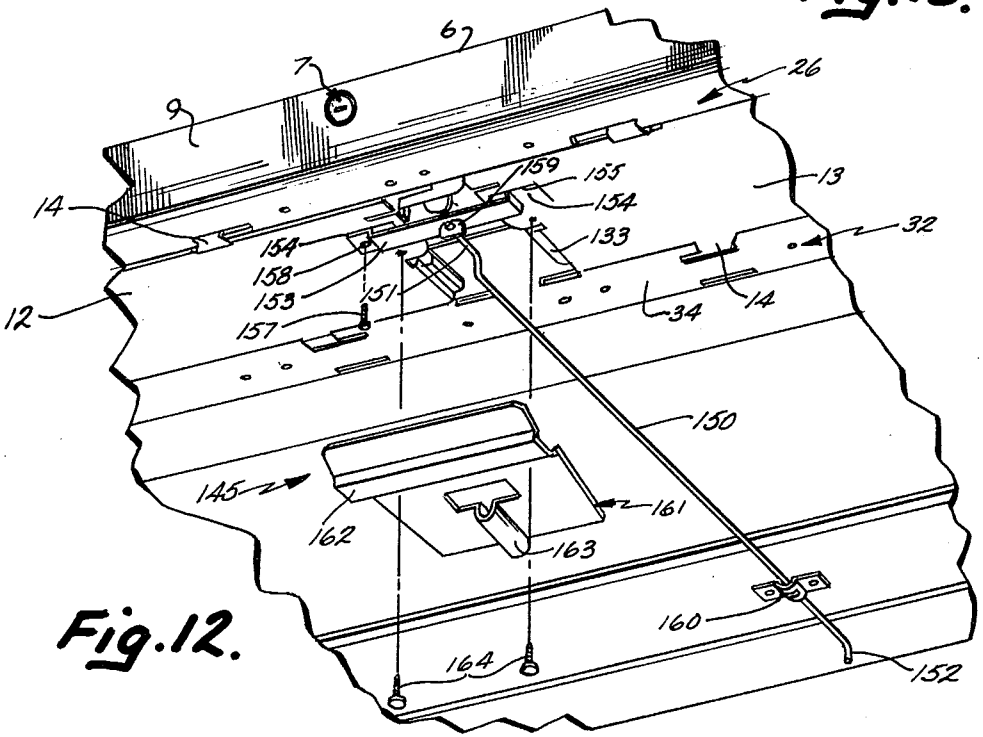
FIG. 12 is a perspective view of a center drawer lock embodiment of the present lock arrangement.

The illustrated furniture unit 2 (FIG. 1) comprises a desk, having side panels 22, which support top 6, and a rear panel 23. As best illustrated in FIGS. 6 and 11, top 6 has a hollow construction, comprising a formed, rigid shell 24 constructed of steel or other similar materials, which is bent rearwardly in a U-shaped fashion along the forward edge 9 of top 6. A cover layer 25, such as vinyl, formica, or the like, overlies shell 24, and is adhered thereto to provide an aestheticallypleasing appearance and a suitable writing surface. A generally U-shaped reinforcing rib or channel 26 extends along the forward side of the interior of top 6, and includes upper flanges 27, which are oriented rearwardly, and are fixedly attached to the lower surface of shell 24. A trim strip 28 is attached to the base portion 29 of reinforcing channel 26 by fasteners 30, and covers the free edge of cover layer 25. The upstanding legs 31 of reinforcing channel 26 are mutually parallel, and include mating apertures 36 and 37 (FIG. 11) therethrough in which primary lock 7 is closely received. A second, U-shaped reinforcing rib or channel 32 is fixedly attached to the lower surface of shell 24 at a location spaced rearwardly of reinforcing channel 26, and is disposed generally parallel therewith. Reinforcing channel 32 includes oppositely oriented flanges 33 attached to the lower surface of shell 24, a base 34, and opposite sidewalls 35. The base 29 of reinforcing channel 26 is positioned substantially co-planar with the base 34 of reinforcing channel 32. In this example, the interior sidewalls of channels 26 and 32, in conjunction with that portion of shell 24 disposed therebetween, define the downwardly opening channel 8 in which in-top lock arrangement 1 is disposed. The forward edge 9 of top 6 includes an aperture 38 aligned with channel apertures 36 and 37, in which primary lock 7 is received and protrudes through the front of desk 2. Reinforcing channels 26 and 32 not only form lock channel 8, but they also add rigidity and strength to the hollow top construction 6. The reinforced top 6 is lightweight, and requires less material than prior units of comparable strength.

Pedestals 3 (FIG. 1) are suspended from the lower side of top 6, at selected positions therealong. In this example, furniture unit 2 includes a single pedestal 3 mounted on the right-hand side of desk 2. However, it is to be understood that furniture unit 2 may include more than one pedestal, and that each pedestal 3 is suspended from top 6 at various positions.

Figure 3:
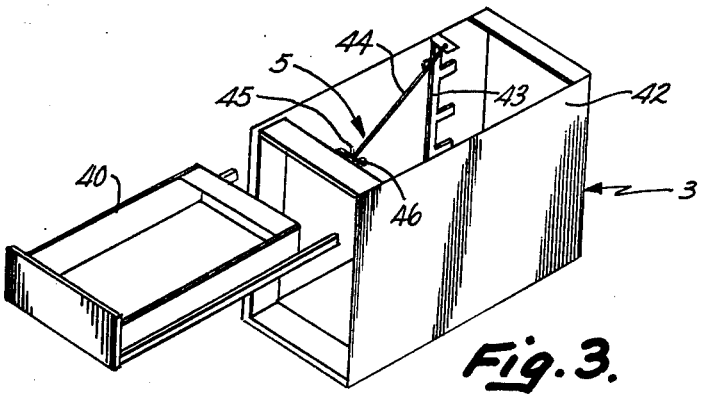
FIG. 3 is an exploded, perspective view of another pedestal for the office furniture unit.

In the illustrated examples, pedestal 3 comprises a drawer unit, having first and second drawers 40 and 41 slidably mounted in an open-top housing 42. Compartment lock mechanisms 5 are manipulated by lateral or side-to-side motion, and in the example shown in FIG. 3, comprises a rear mounted pivotal latch 43, that engages the rear portions of drawers 40 and 41, and locks the same closed. A link 44 connects rear latch 43 with an actuator rod 45, which is mounted in a forward bracket 46, and projects upwardly from the upper surface of housing 42 to engage connecter 10.

Figure 2:
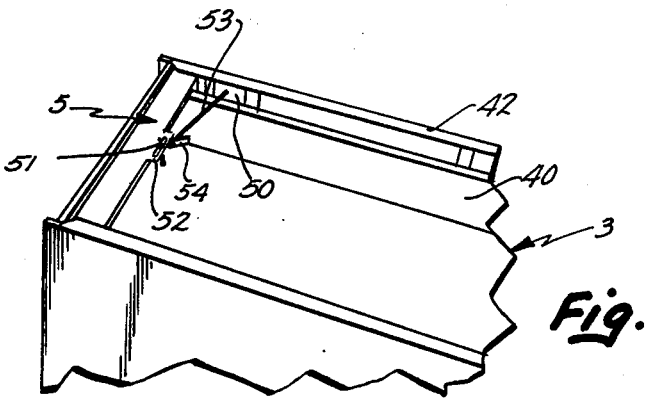
FIG. 2 is a fragmentary, perspective view of a pedestal for the office furniture unit.

In the example illustrated in FIG. 2, pedestal 3 has a front pivotal latch 50, that selectively engages the forward portion of drawers 40 and 41, and locks the same closed. An upstanding actuator arm 51 is mounted in bracket 52, and is connected with front latch 50 by a link 53 and adjustable clip 54.

Primary lock 7 (FIG. 4) preferably comprises a key lock, having a stationary barrel or housing 60 with a tumbler plug or cylinder 61 mounted therein for rotation between locked and unlocked positions. Key lock housing 60 includes an apertured flange 62 at the rearward end thereof to facilitate mounting the lock in top 6, and a collar 63 at the forward end of housing 60 to center the lock in reinforcing rib aperture 36. A drive shaft 64 extends from the rear of housing 60, is connected with tumbler cylinder 61, and rotates therewith. Except as noted herein, key lock 7 has an otherwise conventional construction, and includes a plurality of tumblers (not shown) mounted in cylinder 61, and means for positively stopping rotation of cylinder 61 at the locked and unlocked positions. The illustrated tumbler cylinder 61 rotates 90° between the locked and unlocked positions. A key 65 (FIGS. 5 and 6) manipulates the lock tumblers (not shown) to permit rotation of cylinder 61.

In the illustrated arrangement, key lock 7 is concealed within the thickness of top 6 to provide a truly in-top lock construction. Key lock 7 is preferably detachably mounted in top 6 by inserting the forward portion of the lock through the aligned, mating apertures 37–38 in reinforcing channel 26 and forward edge 9, as illustrated in FIG. 11. Detachable fasteners 66 (FIGS. 5 and 6), in the nature of sheet metal screws, or the like, extend through the apertures in the collar 63 of lock housing 60, and are closely received in mating apertures in the rearward sidewall 31 of front reinforcing channel 26. The overall length of key lock 7 is slightly less than the width of channel 8, such that the key lock can be easily installed and removed from the interior of top 6.

With reference to FIG. 4, the various parts of cover assembly 11 are interconnected so as to enclose the open side of channel 8 to prevent unauthorized access to locking arrangement 1. Left and right-hand end covers 12 and 13 respectively, have a substantially identical construction, except that the various parts are oriented for left and right-hand sides of the assembly. End covers 12 and 13 have a generally U-shaped transverse cross-sectional shape, including base 70, and upstanding sidewalls 71 and 72. Slide latches 14 are mounted on opposite sides of cover members 12 and 13, and in this example comprise a plurality of hook-shaped hangers, having aligned prongs 73, disposed in a mutually parallel relationship, extending in the longitudinal direction of cover member 13, and having free ends 74 oriented toward the exterior ends of the cover members 12 and 13. A plurality of elongate, rectangular slots 75 (FIG. 5) are positioned in the bases 29 and 34 of the forward and rearward reinforcing channels 26 and 32, and closely receive hanger prongs 73 therethrough. In this example, prongs 73 are pierced through the sidewalls 71 and 72 of cover members 12 and 13, and include an outwardly extending arm 76 with prongs 73 upstanding therefrom. The prongs 73 have lower abutment surfaces 77, which engage the upper surfaces of channel bases 29 and 34, whereby in the mutually diverged, locked position, the lower surfaces of covers 12 and 13 and channels 26 and 32 are substantially co-planar or flush.

Connector mechanism 10 (FIG. 4), interconnects primary lock 7 with the actuator arm of pedestal 3, and comprises a pair of lock slides 81 and 82, which are slidably mounted on the upper sides of covers 12 and 13, and reciprocate side-to-side as key lock 7 is rotated.

The left and right-hand lock slides, 81 and 82 respectively have a generally U-shaped transverse cross-sectional configuration, comprising a base 83, with upstanding sidewalls 84 and 85. The channel bases 83 include a series of aligned apertures or perforations 86 (FIG. 5) therethrough in which the pedestal actuator rod 45 or 51 is captured, as described in greater detail hereinafter. The interior ends 87 (FIG. 4) of lock slides 81 and 82 include integrally formed, upstanding tabs 88, with horizontal slots 89 through the upper ends of the tabs. Tabs 88 are formed by laterally slicing the channel, and forming the tab upwardly, such that a narrower channel portion 90 is formed between tab 88 and the rearward sidewall 85.

In the illustrated structure, pierced, inverted L-shaped flanges 95 (FIGS. 4 and 5) project upwardly from the base 70 of end covers 12 and 13, and are aligned in a parallel relationship with the forward sidewall 71 of end covers 12 and 13. Pierced protuberances 96 are formed in the forward sidewalls 71 of end covers 12 and 13, and extend laterally outwardly toward flanges 95. The distance between the vertical leg 97 of flange 95, and the interior surface of forward sidewall 84 is slightly greater than the width of lock slides 81 and 82 to closely receive the same therebetween. The distance between the base 70 of end covers 12 and 13 and the horizontal leg 98 of flange 95, as well as the outwardly protruding portion 99 (FIG. 6) of protuberance 96 is substantially equal to the height of associated lock slide sidewalls 84 and 85, whereby flanges 95 and protuberance 96 form guides on cover members 12 and 13 in which lock slides 81 and 82 reciprocate.

An actuator assembly 103 (FIG. 4) interconnects lock slides 81 and 82 with the drive shaft portion 64 of key lock 7. Actuator assembly 103 comprises a link 104, having laterally offset, L-shaped tabs 105 at opposite ends thereof, which are shaped to be closely received through the slots 89 in lock slide tabs 88. A crank arm 106 is detachably connected with key lock shaft 64 by a fastener 107, and includes a non-circularly shaped window through which a mating portion of key lock shaft 64 is received, such that crank arm 106 rotates with tumbler cylinder 61. A lock washer 108 is positioned over fastener 107 and securely retains crank arm 106 on lock drive shaft 64. Crank arm 106 includes a laterally extending bracket arm 109 to which one end of a coil spring 110 is attached. The opposite end of spring 110 is anchored to left-hand cover 12, to resiliently urge the actuator assembly 103 into a normally locked position. An actuator arm 111 has one end pivotally connected with crank arm 106 at pivot point 112, and the opposite end is pivotally connected with a medial portion of link 104 at pivot point 113, whereby rotation of tumbler cylinder 61 reciprocates both lock slides 81 and 82.

The illustrated actuator assembly 103 is particularly adapted for over-centered lock embodiments, and is described in detail in my co-pending U.S. patent application entitled OVER-CENTERED LOCK ARRANGEMENT FOR OFFICE FURNITURE UNITS, which has already been referenced hereinabove. Actuator assembly 103 is configured such that in the locked position, pivot points 112 and 113 are oriented in an over-centered relationship with respect to the axis of rotation of tumbler cylinder 61, whereby external forces applied to lock slides 81 and 82 in a direction to unlock pedestal 3 rotatably urge tumbler cylinder 61 further toward the locked position to prevent damage to the lock tumblers, and facilitate insertion and withdrawal of key 65.

Center cover 15 encloses the remaining, medial portion of channel 8, and is detachably connected with the left and right-hand end covers 12 and 13 to provide ready access to primary lock 7. The width of channel 8, at least at that position which center cover 15 encloses, is sufficient to remove key lock 7 by translating the lock rearwardly and downwardly, as described in detail hereinafter. With reference to FIG. 4, center cover 15 includes a base 119, having an end wall 120 upstanding from the rear edge thereof. Slots 121 extend through the opposite sides of the lower edge of rear wall 121 and define wing-shaped free ends 118 for purposes to be described in greater detail below. A pair of hook-shaped hangers 122 are connected with the side edges of cover base 120, and include forwardly extending prongs 123. The forward portion 124 of base 120 is slightly narrower than the rearward base portion, and includes a recess or channel 125 extending laterally thereacross. A front wall 126 extends upwardly along the front edge of base 120, and includes outwardly extending free ends 127, in the nature of wings for purposes to be described below. A stop or tab 128 protrudes upwardly from the forward portion 124 of base 120, along the side edge thereof, and has a rearward edge disposed adjacent to channel 125.

As best illustrated in FIG. 5, the interior ends of covers 12 and 13 include upstanding, inverted L-shaped flanges 133, having elongate, rectangularly shaped slots 134, and circular fastener apertures 135 disposed adjacent the forward, interior corner of the upper leg of flanges 133. At the forward side of the base portion 70 of end covers 12 and 13, elongate slots 136 extend through the end edges, and are oriented generally parallel with the longitudinal axis of the end covers. Slots 136 are aligned with each other, and are shaped to receive the free ends 127 of center cover front wall 126 therethrough. Inverted L-shaped flanges 137 extend rearwardly from the forward sidewalls 71 of covers 12 and 13, and are positioned over at least a portion of slots 136. The horizontal legs 138 of flanges 137 are disposed at an elevation which is substantially commensurate with the height of center cover front wall 126, such that the free ends 127 of front wall 126 are captured between flange legs 138 and the bases 70 of end covers 12 and 13.

Figure 7:
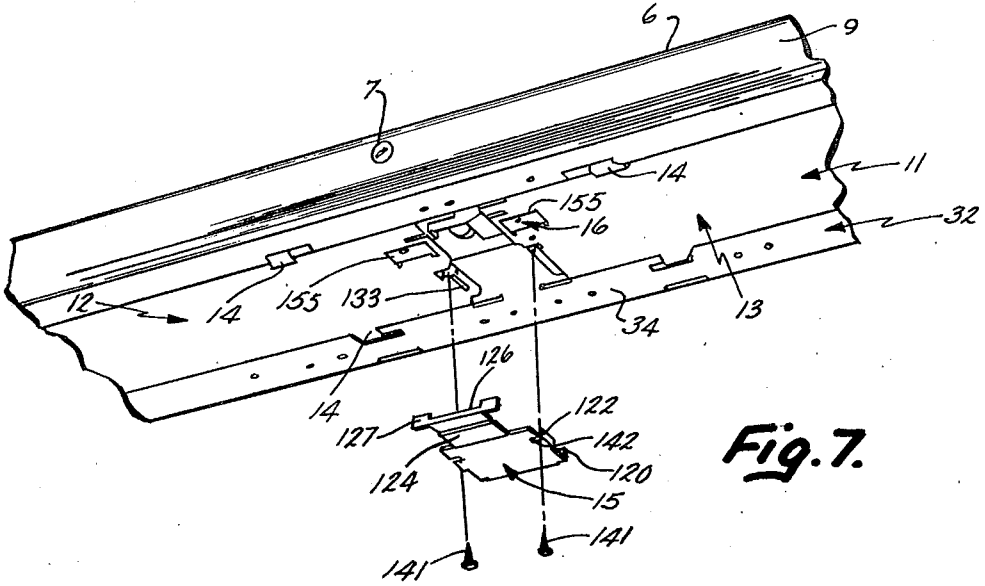
FIG. 7 is a fragmentary, perspective view of the lock arrangement, taken from a lower side thereof, and showing the center cover in a disassembled condition.
Figure 8:
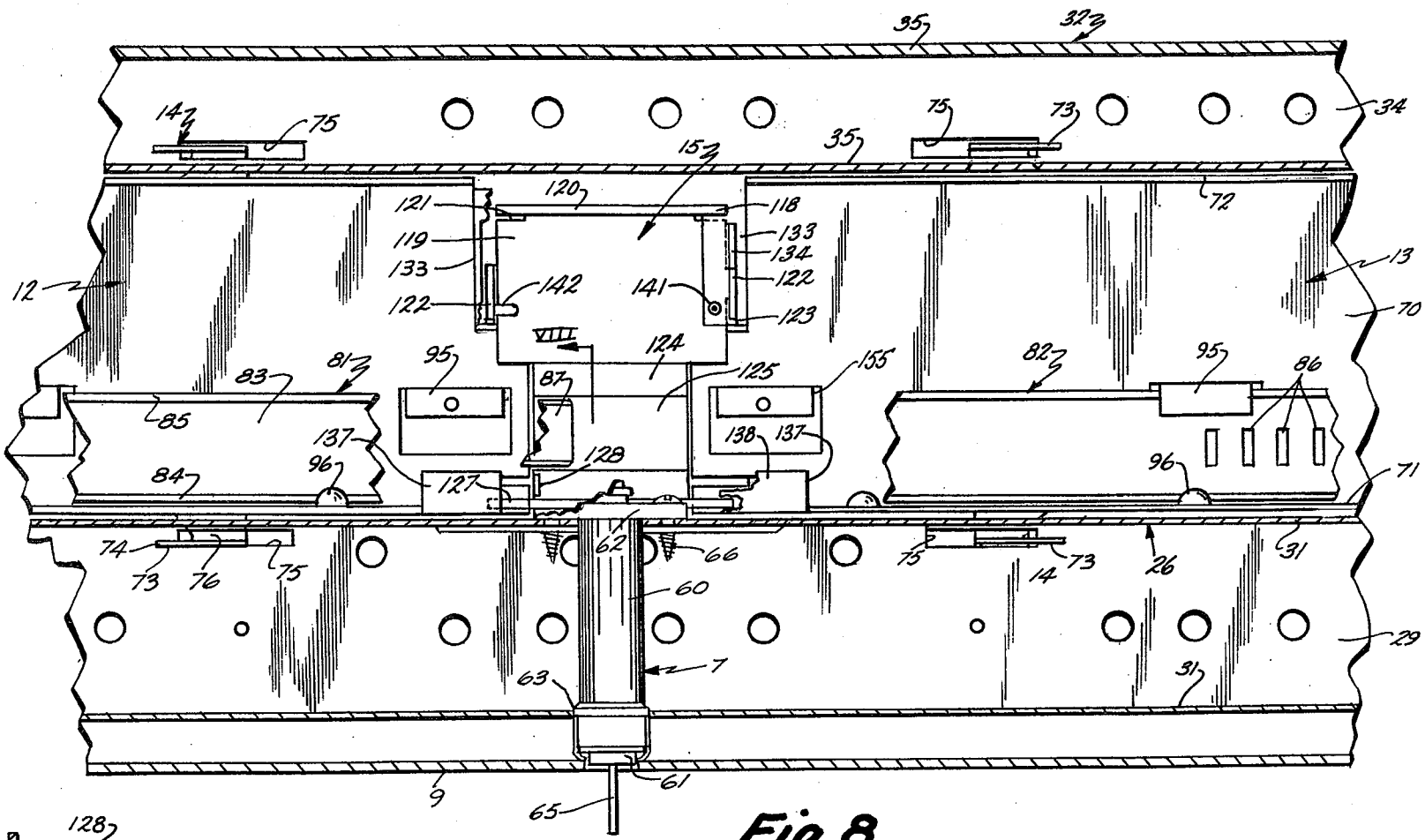
FIG. 8 is a fragmentary, horizontal cross-sectional view of the lock arrangement, with the center cover shown installed.
Figure 8A:
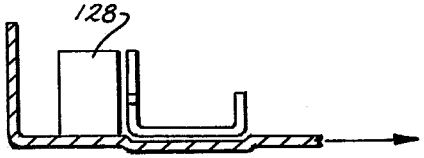
FIG. 8A is a fragmentary, vertical cross-sectional view of the lock arrangement, taken along the line VIIIA-VIIIA of FIG. 8.

As best illustrated in FIGS. 7, 8 and 8A, center cover 15 is attached to end covers 12 and 13 in the following manner. Center cover 15 is positioned directly below the opening formed between the interior ends of end covers 12 and 13, as shown in FIG. 7. The front wall 126 of cover 15 is disposed directly in line with slots 136, and the rear wall 128 of cover 15 is positioned in alignment with the gap formed between the rear edge of flanges 133 and the forward sidewall 35 of reinforcing channel 32. In this position, hook-shaped hangers 122 are disposed directly below, and in alignment with mating slots 134. With key lock 7 in the unlocked position, cover 15 is then translated upwardly, such that the forward and rearward walls 126 and 120 of cover 15, as well as hanger 122 are received through their mating apertures in the interior ends of end covers 12 and 13. Cover 15 is then translated forwardly, such that hangers 122 engage flanges 133, the free ends 118 of rear wall 121 engage flanges 133, and the free ends 127 of front wall 126 are captured between the bases 70 of end covers 12 and 13 and the horizontal legs 138 of flanges 137.

In this locked position, cover member 15 prevents convergence of end covers 12 and 13, such that they cannot be converged and removed without first removing center cover 15. Fasteners 141 (FIGS. 7 and 8) are inserted through side slots 142 in center cover 15, and engage apertures 135 in flanges 133 to positively retain the center cover in position when the lock assembly is shifted between the locked and unlocked positions. When key lock 7 is rotated into the locked position shown in FIG. 8, the interior end 87 of the left-hand lock slide 81 extends into the channel 125 of center cover 15 behind stop tab 128. Hence, when key lock 7 is in the locked position, even if cover fasteners 141 are removed, center cover 15 cannot be removed, since abutment between tab 128 and interior end 87 of the left-hand lock slide 81 prevents rearward translation of the center cover. When key lock 7 is rotated to the unlocked position, the interior end 87 of left-hand lock slide 81 is retracted back into the left-hand end cover 12 to permit tab 128 to slide rearwardly past the forward edge of the same.

Figure 10:
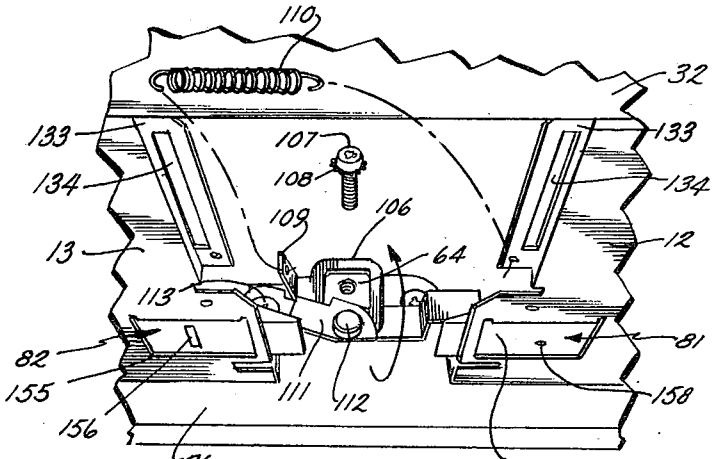
FIG. 10 is a fragmentary, perspective view of the lock arrangement, with the lock slide link shown attached to the primary lock.

To change key lock 7, key 65 is inserted into the lock, and tumbler cylinder 61 is rotated to the unlocked position. Cover screws 141 are then removed, and center cover 15 is pushed rearwardly until hangers 122, and the free ends of cover walls 120 and 126 are vertically aligned with their mating apertures. Cover 15 is then pulled downwardly out of engagement with the top 6. Actuator spring 110 is removed, and fastener 107 is detached so that crank arm 106 can be slid rearwardly off of lock shaft 64. Actuator assembly 103 is then rotated upwardly, in the direction of the arrow shown in FIG. 10, and link tabs 105 are withdrawn from the mating slots 89 in the interior ends of lock slides 81 and 82. Next, lock fasteners 66 are removed and lock 7 is pulled rearwardly out through channel 8. Lock 7 is replaced by simply reversing the above-described sequence of steps.

Figure 9:
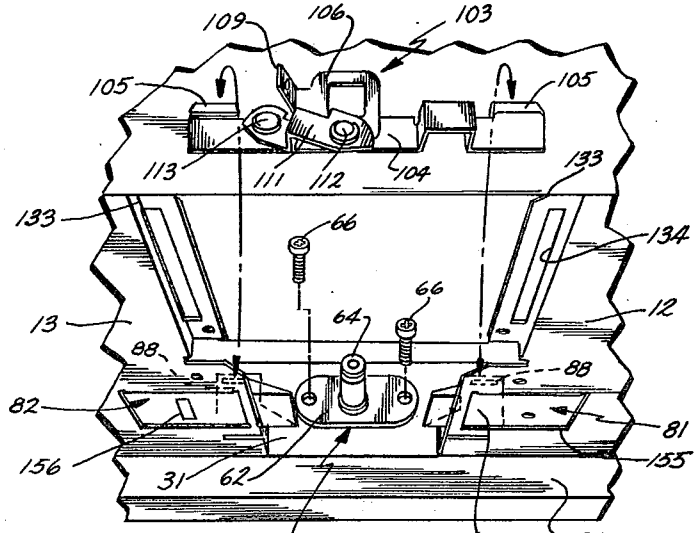
FIG. 9 is a fragmentary, perspective view of the lock arrangement, with a lock slide link member detached therefrom.

A center drawer adapter 145 is illustrated in FIGS. 12-16, and provides a mechanism to lock a center drawer 146, which is slidably suspended from the lower surface of top 6 by brackets 147. Center drawer 146 has a generally conventional construction, and includes a forward well 148, and a rearward lock channel 149. A lock rod 150 is rotatably supported on the lower surface of top 6, and has a forward end 151, which is laterally offset from the longitudinal axis of rod 150 to form a crank. The rearward end 152 of lock rod 150 is L-shaped, and selectively engages lock channel 149 to retain center drawer 146 closed. A lock rod actuator 153 is connected with lock slides 81 and 82, and pivots lock rod 150. The ends of actuator 153 include inverted L-shaped ends 154, which extend through the interior windows 155 in the bases 70 of cover members 12 and 13, which are formed in piercing flanges 95. The right-hand end of actuator 153 is received in a mating slot 156 (FIGS. 9 and 10) in the interior end of right-hand lock slide 82. The left-hand end of actuator 153 is attached to the interior end of the left-hand lock slide 81 by a fastener 157, received in a mating aperture 158, such that actuator 153 reciprocates with lock slides 81 and 82. Actuator 153 includes a centrally positioned, depending bracket 159, having a vertically elongated aperture in which the forward end 151 of lock rod 150 is pivotally received, such that reciprocaton of actuator 153 rotates lock rod 150 between locked and unlocked positions. A rear, U-shaped bracket 160 is attached to the lower surface of top 6 by fasteners 165, and rotatably supports the rearward end of lock rod 150.

Center drawer adapter assembly 145 includes a special cover 161 to replace previously described center cover 15. Cover 145 encloses the open area between the interior ends of cover members 12 and 13, as well as windows 155. Cover 145 includes a laterally extending recess or channel 162 in which actuator 153 reciprocates, and a rearwardly extending, U-shaped trough 163 in which the forward end of lock rod 150 is rotatably supported. Cover 161 is attached to the interior ends of end covers 12 and 13 by fasteners 164. Since cover 161 is disposed within the confines of center drawer 146 in the locked position, only authorized personnel are permitted access to the lock arrangement 1.

Figure 15:
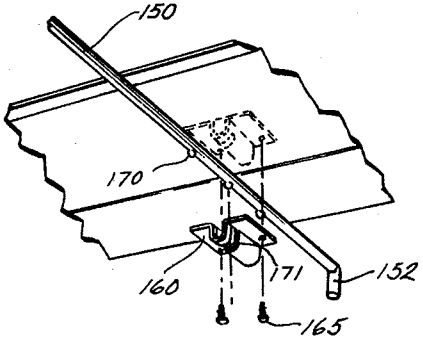
FIG. 15 is an exploded perspective view of an actuator rod portion of the center drawer lock arrangement.
Figure 16:
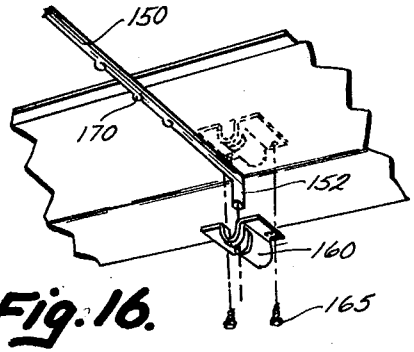
FIG. 16 is a fragmentary, perspective view of the actuator rod for the center drawer lock arrangement, shown in a position to accommodate deep work surfaces.
Figure 14:
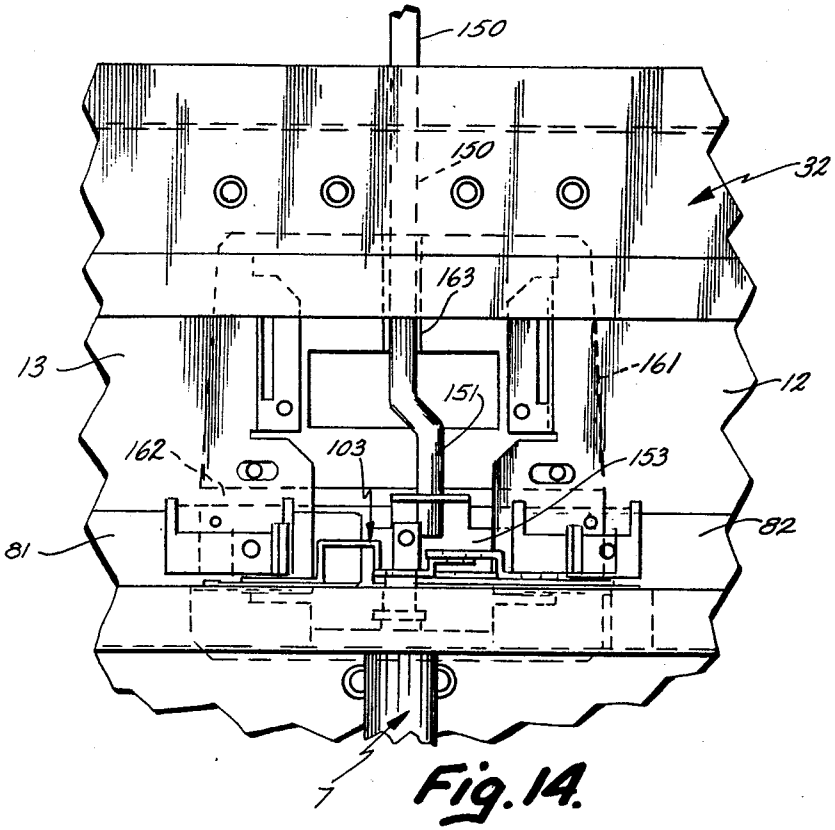
FIG. 14 is a fragmentary, bottom plan view of the center drawer lock arrangement.

As best illustrated in FIGS. 15 and 16, the rearward portion of lock rod 150 includes a plurality of spaced apart, downwardly protruding ears 170, which are shaped for close reception in a slot 171 through rear bracket 160. For relatively shallow work surfaces, bracket 160 is positioned so that an appropriate one of the lock rod ears 170 is received through slot 171. For relatively deep work surfaces, the rearward end 152 of lock rod 150 extends through bracket slot 171.

Center drawer 146 is installed in the following manner. Center cover 15 is removed from furniture unit 2 in the manner described above. Drawer brackets 147 are attached to the lower surface of top 6 at the desired location. The lateral position of center drawer brackets 146 under top 6 can be varied as desired, so long as the access opening which cover 161 encloses remains within the interior of center drawer 146. Actuator 153 is attached to lock slides 81 and 82, and the forward end 151 of lock rod 150 is positioned in bracket 159. Rear bracket 160 is then installed, and cover 161 is attached to end covers 12 and 13 by fasteners 164. Center drawer 146 is then inserted between support brackets 147.

To assemble a pedestal 3 to furniture unit 2, pedestal 3 is positioned under top 6 at one of several preselected locations. Pedestal 3 is raised upwardly toward the lower surface of top 6, and actuator rod 45 or 51 is inserted through a vertically aligned one of the windows 155 in end covers 12 or 13, and thence through a mating perforation 86 in the associated one of the lock slides 81 or 82. Fasteners (not shown) attach pedestal 3 to the lower side of top 6 in a suspended fashion. Reciprocation of lock slides 81 and 82 laterally shifts actuator 153, which rotates rod 150 to lock and unlock compartment 4.

Lock arrangement 1 provides a very compact, economical construction, which is very strong, durable, and particularly adapted for in-top lock arrangements. The three-piece cover assembly permits easy access to the primary lock 7, such that even unskilled personnel can remove and replace the same, yet has sufficient security to prevent surreptitious entry. An internally mounted lock arrangement retains the center cover 15 in position, and is preferably operably connected with the primary lock 7, such that shifting the primary lock between the locked and unlocked positions automatically locks and unlocks the cover 15, whereby only personnel having a key to lock 7 can gain access to the lock arrangement. The center drawer adapter 145 easily and quickly converts the lock arrangement 1 for use in center drawer constructions.

In the foregoing description it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A lock arrangement for office furniture units such as desks, credenzas and the like, that include one or more pedestals defining at least one closable compartment, such as a drawer, a cabinet or the like, with means for locking said compartment closed, and a top extending the length of said unit, said lock arrangement comprising:

a primary lock mounted in said unit adjacent said top, and having locked and unlocked positions;

a channel opening downwardly from a lower surface of said top; said primary lock having a portion thereof communicated with the interior of said channel;

means for mechanically connecting said primary lock with said compartment locking means, whereby shifting said primary lock between the locked and unlocked positions locks and unlocks said compartment; said connecting means being positioned within said channel;

a removable cover assembly having a three-piece construction, comprising:

first and second covers shaped to enclose opposite ends of said channel;

first slide latch means connected with said first and second covers;

second slide latch means connected with said channel, and mating with said first slide latch means, whereby said first and second covers are positioned over the opposite ends of said channel and diverged longitudinally into a locked position, wherein said first and second slide latch means are engaged and prevent downward removal of said first and second covers from said channel;

a third cover shaped to enclose a medial portion of said channel; said third cover being shaped to be vertically inserted between and abut adjacent interior ends of said first and second covers to prevent longitudinal convergence of said first and second covers from the locked position; and means for locking said third cover in place between said first and second covers to permit only authorized access to said locking arrangement.

2. A lock arrangement as set forth in claim 1, wherein:

said primary lock is mounted within said top to define an in-top lock arrangement.

3. A lock arrangement as set forth in claim 2, wherein:

said primary lock is positioned adjacent to the medial portion of said channel, whereby removal of said third cover provides direct access to said primary lock.

4. A lock arrangement as set forth in claim 3, wherein:

said primary lock is detachably connected with said top by fasteners which are accessible only through said channel.

5. A lock arrangement as set forth in claim 4, wherein:

said channel is sufficiently wide to permit said primary lock to be easily removed and replaced therethrough.

6. A lock arrangement as set forth in claim 5, including:

means for connecting said primary lock with said third cover locking means, whereby shifting said primary lock between the locked and unlocked positions automatically locks and unlocks said third cover.

7. A lock arrangement as set forth in claim 6, wherein said third cover locking means further includes:

third slide latch means connected with said third cover;

fourth slide latch means connected with the interior ends of said first and second covers, whereby fore-to-aft translation of said third cover engages said third and fourth slide latch means into a locked position to prevent downward removal of said third cover; and means for selectively retaining said third cover member in the locked position.

8. A lock arrangement as set forth in claim 7, wherein:

said primary lock comprises a key lock having a tumbler cylinder which is rotated between the locked and unlocked positions.

9. A lock arrangement as set forth in claim 8, wherein:

said mechanical connecting means includes first and second lock slides slidably mounted on an interior side of said first and second covers respectively, and means for connecting said lock slides with said tumbler cylinder, whereby rotation of said tumbler cylinder reciprocates said lock slides.

10. A lock arrangement as set forth in claim 9, wherein:

one of said lock slides defines at least a portion of said third cover retaining means.

11. A lock arrangement as set forth in claim 10, wherein said third cover retaining means further includes:

a tab upstanding from a forward portion of said third cover, and positioned to abut an interior end of said one lock slide in the locked position to prevent fore-to-aft translation of said third cover in the direction of third cover removal.

12. A lock arrangement as set forth in claim 11, wherein:

said lock slide connecting means comprises a link interconnecting the interior ends of said lock slides.

13. A lock arrangement as set forth in claim 12, including:

means for detachably connecting said link with said lock slides to facilitate removal and replacement of said primary lock.

14. A lock arrangement as set forth in claim 13, wherein said lock slide connecting means further comprises:

a cam arm detachably attached to and rotating with said tumbler cylinder;

an actuator arm having a first end pivotally connected with said crank arm at a first pivot point, and a second end pivotally connected with said link at a second pivot point, whereby rotation of said tumbler cylinder reciprocates said lock slides.

15. A lock arrangement as set forth in claim 14, wherein:

said first and second pivot points assume an overcentered relationship with respect to the axis of rotation of said tumbler cylinder in the locked position, whereby external forces applied to said lock slides in a direction to force said lock arrangement unlocked, rotatably urge said tumbler cylinder further toward the locked position.

16. A lock arrangement as set forth in claim 15, wherein:

said compartment locking means includes an upstanding actuator rod shaped to engage one of said lock slides at multiple positions therealong.

17. A lock arrangement as set forth in claim 16, wherein:

said channel has a generally inverted U-shape, defined by a top, depending parallel sidewalls, and end walls along the lower edges of said sidewalls.

18. A lock arrangement as set forth in claim 17, wherein said first slide latch means for said first and second covers comprises:

a plurality of hook-shaped hangers disposed along both sides of said first and second covers; said hangers having prongs which are mutually parallel, extend in the longitudinal direction of said first and second covers, and have free ends oriented toward exterior ends of said first and second covers.

19. A lock arrangement as set forth in claim 18, wherein said second slide latch means for said first and second covers comprises:

a plurality of slots disposed in the end walls of said channel, and positioned for closely receiving said hangers prongs therethrough.

20. A lock arrangement as set forth in claim 19, wherein:

said first and second covers have a generally U-shape, defined by a base with a lower surface and upstanding parallel sidewalls.

21. A lock arrangement as set forth in claim 20, wherein:

said hanger prongs are positioned laterally outwardly of said cover sidewalls, and have lower abutment surfaces disposed slightly above the base of said first and second covers, whereby in the locked position, the lower surfaces of said first and second covers are substantially flush with the end walls of said channels.

a bracket mounted on and depending from the lower surface of said top, and rotatably supporting a rearward portion of said actuator rod.

40. A lock arrangment as set forth in claim 1, wherein:

said primary lock is positioned adjacent to the medial portion of said channel, whereby removal of said third cover provides direct access to said primary lock.

41. A lock arrangement as set forth in claim 1, wherein:

said primary lock is detachably connected with said top by fasteners which are accessible only through said channel.

42. A lock arrangement as set forth in claim 1, wherein:

said channel is sufficiently wide to permit said primary lock to be removed and replaced from said unit through said channel.

43. A lock arrangement as set forth in claim 1, wherein:

means for connecting said primary lock with said third cover locking means, whereby shifting said primary lock between the locked and unlocked positions automatically locks and unlocks said third cover.

44. A lock arrangement as set forth in claim 1, wherein said third cover locking means comprises:

third slide latch means connected with said third cover;

fourth slide latch means connected with interior ends of said first and second covers whereby fore-to-aft translation of said third cover engages said third and fourth slide latch means into a locked position to prevent downward removal of said third cover; and means for selectively retaining said third cover in the locked position.

45. A lock arrangement as set forth in claim 1, wherein:

said primary lock comprises a key lock, having a tumbler cylinder which is rotated between the locked and unlocked positions.

46. A lock arrangement as set forth in claim 45, wherein:

said mechanical connecting means includes at least one lock slide slidably mounted in said channel, and means for connecting said lock slide with said tumbler cylinder, whereby rotation of said tumbler cylinder reciprocates said lock slide.

47. A lock arrangement as set forth in claim 46, wherein:

said lock slide defines a portion of said third cover retaining means, whereby reciprocation of said lock slide automatically locks and unlocks said third cover.

48. A lock arrangement as set forth in claim 47, wherein said third cover retaining means further includes:

a tab upstanding from a forward portion of said third cover, and positioned to abut a mating portion of said lock slide in the locked position to prevent fore-to-aft translation of said third cover member in the direction of third cover removal.

49. A lock arrangement as set forth in claim 1, wherein:

said top is hollow, and includes an upper, rigid support sheet which is reverse bent along a forward edge thereof to define a front edge of said top.

50. A lock arrangement as set forth in claim 49, wherein:

said channel is defined between first and second generally U-shaped channels, which are positioned adjacent the front edge of said top, spaced laterally apart, extend mutually parallel, and are attached to a lower surface of said support sheet, thereby reinforcing said top.

51. A lock arrangement as set forth in claim 1, wherein:

said channel has a generally inverted U-shape, defined by a top, depending parallel sidewalls, and end walls along the lower edges of said sidewalls.

52. A lock arrangement as set forth in claim 51, wherein said first slide latch means for said first and second covers comprises:

a plurality of hook-shaped hangers disposed along both sides of said first and second covers; said hangers having prongs which are mutually parallel, extend in the longitudinal direction of said first and second covers, and have free ends oriented toward exterior ends of said first and second covers.

53. A lock arrangement as set forth in claim 52, wherein said second slide latch means for said first and second covers comprises:

a plurality of slots disposed in the end walls of said channel, and positioned for closely receiving said hanger prongs therethrough.

54. A lock arrangement as set forth in claim 1, wherein:

said first and second covers have a generally U-shape, which is defined by a base with a lower surface, and upstanding parallel sidewalls.

55. A lock arrangement as set forth in claim 1, wherein said third cover locking means includes:

at least two hook-shaped hangers disposed adjacent opposite sides of said third cover at a rearward portion thereof; said hangers having prongs which are mutually parallel, extend in the longitudinal direction of said third cover, and have free ends oriented toward a forward portion of said third cover.

56. A lock arrangement as set forth in claim 55, wherein said third cover locking means further includes:

mating slots in interior ends of said first and second covers, which extend in a fore-to-aft direction, and are positioned for closely receiving said third cover hanger prongs therethrough.

57. A lock arrangement as set forth in claim 1, wherein:

said office furniture unit includes a center drawer; and including a center drawer lock arrangement comprising:

a lock rod rotatably mounted on the lower surface of said top, and having forward and rearward ends; said forward end being laterally offset from the longitudinal axis of said lock rod to form a crank; said rearward end of said rod being L-shaped, and selectively engaging a mating portion of said center drawer to lock said center drawer closed;

a lock rod actuator connected to and reciprocating with said mechanical connecting means;

22. A lock arrangement as set forth in claim 21, wherein said third slide latch means for said third cover includes:

at least two hook-shaped hangers disposed adjacent opposite sides of said third cover at a rearward portion thereof; said hangers having prongs which are mutually parallel, extend in the longitudinal direction of said third cover, and have free ends oriented toward a forward portion of said third cover.

23. A lock arrangement as set forth in claim 22, wherein said fourth slide latch means for said third cover includes:

mating slots in the interior ends of said first and second covers, extending in the fore-to-aft direction, and positioned for closely receiving said third cover members hanger prongs therethrough.

24. A lock arrangement as set forth in claim 23, wherein said third slide latch means for said third cover further includes:

a front wall upstanding from a forward end of said third cover member, and including free ends which extend outwardly of an adjacent base portion of said third cover member.

25. A lock arrangement as set forth in claim 24, wherein said fourth slide latch means for said third cover further includes:

first and second slots disposed through the base of said first and second covers adjacent a forward one of said cover member sidewalls; said first and second slots extending in the longitudinal direction of said first and second covers, and being shaped to receive the free ends of the front wall of said third cover therethrough, whereby forward translation of said third cover locks the same onto said first and second cover members.

26. A lock arrangement as set forth in claim 25, wherein:

said forward sidewalls of said first and second cover members include an inverted L-shaped flange disposed adjacent said first and second slots, in which the free ends of said third cover front wall are captured in the locked position.

27. A lock arrangement as set forth in claim 26, wherein:

said third cover includes a recessed channel extending transversely across the base thereof in which the interior ends of said lock slides reciprocate.

28. A lock arrangement as set forth in claim 27, wherein:

said interior ends of said first and second covers include inwardly facing L-shaped flanges, having horizontal legs in which said first and second slots are disposed.

29. A lock arrangement as set forth in claim 28, wherein:

said third cover includes a rear wall upstanding from a rearward edge of said third cover base, with slots extending through opposite sides of said rearward edge to define opposite free ends of said rear wall, whereby in the locked position, said rear wall free ends are supported on said inwardly facing, L-shaped flanges.

30. A lock arrangement as set forth in claim 29, including:

at least once fastener extending through the base of said third cover, and detachably connecting the same with one of said first and second covers.

31. A lock arrangement as set forth in claim 30, wherein:

said primary lock fasteners are screws which can be installed and removed only through said channel.

32. A lock arrangement as set forth in claim 31, wherein:

said channel has a width slightly larger than the length of said primary lock to facilitate removal and replacement of said primary lock.

33. A lock arrangement as set forth in claim 32, wherein:

said tab on said third cover extends upwardly from a side edge of said third cover base, between the channel and the front wall of said third cover.

34. A lock arrangement as set forth in claim 33, wherein:

said first and second cover bases include at least two pierced, inverted L-shaped flanges, positioned mutually in-line, and facing the forward sidewalls of said first and second covers; and said forward sidewalls of said first and second covers include pierced, inwardly projecting protrusions, which in conjunction with said flanges, form guides in which said lock slides reciprocate.

35. A lock arrangement as set forth in claim 34, wherein:

said office furniture unit includes a center drawer; and including a center drawer lock arrangement comprising:

a lock rod rotatably mounted on the lower surface of said top, and having forward and rearward ends; said forward end being laterally offset from the longitudinal axis of said lock rod to form a crank; said rearward end of said rod being L-shaped, and selectively engaging a mating portion of said center drawer to lock said center drawer closed;

a lock rod actuator connected to and reciprocating with said lock slides;

means for pivotally connecting the forward end of said lock rod with said actuator, whereby shifting said primary lock between the locked and unlocked positions engages and disengages the rearward end of said actuator rod with said center drawer to lock and unlock said center drawer.

36. A lock arrangement as set forth in claim 35, including:

an alternate cover for said center drawer lock arrangement, which replaces said third cover, and includes removable fasteners which attach said alternate cover to said top, and position said alternate cover within the confines of said center drawer when it is closed, whereby in the locked position, said center drawer permits only authorized access to said locking arrangement.

37. A lock arrangement as set forth in claim 36, wherein:

said alternate cover includes a transverse channel in which said actuator reciprocates.

38. A lock arrangement as set forth in claim 37, wherein:

said cover includes a rearwardly extending channel in which a forward portion of said actuator rod is rotatably supported.

39. A lock arrangement as set forth in claim 38, including:

means for pivotally connecting the forward end of said lock rod with said actuator, whereby shifting said primary lock between the locked and unlocked positions engages and disengages the rearward end of said actuator rod with said center drawer to lock and unlock said center drawer.

58. A lock arrangement as set forth in claim 57, including:

an alternate cover for said center drawer lock arrangement, which replaces said third cover and includes removable fasteners which attach said alternate cover to said top, and position said alternate cover within the confines of said center drawer when it is closed, whereby in the locked position, said center drawer permits only authorized access to said locking arrangement.

59. A lock arrangement as set forth in claim 58, wherein:

said alternate cover includes a transverse channel in which said actuator reciprocates.

60. A lock arrangement as set forth in claim 58, wherein:

said cover includes a rearwardly extending channel in which a forward portion of said actuator rod is rotatably supported.

61. A lock arrangement as set forth in claim 58, including:

a bracket mounted on and depending from the lower surface of said top, and rotatably supporting a rearward portion of said actuator rod.

62. A lock arrangement for office furniture units such as desks, credenzas and the like, that include at least one closable compartment therein, such as a drawer, a cabinet, or the like, with means for locking said compartment closed, and a top extending the length of said unit, said lock arrangement comprising:

a removable primary lock positioned within said top to define an in-top lock arrangement, and having locked and unlocked positions;

a channel opening downwardly from a lower surface of said top; said channel being shaped to permit said primary lock to be removed and replaced from said unit through said channel;

means for detachably connecting said primary lock with said top by fasteners which are accessible only through said channel;

means for mechanically connecting said primary lock with said compartment locking means, whereby shifting said primary lock between the locked and unlocked positions locks and unlocks said compartment; said connecting means being positioned within said channel;

a removable cover shaped to enclose said channel and prevent unauthorized access thereto;

means for selectively locking said cover over said channel in a closed position; said cover locking means being positioned wholly within said channel for security;

means for operably connecting said cover locking means with said primary lock, whereby shifting said primary lock between the locked and unlocked positions automatically locks and unlocks said cover, thereby permitting only authorized access to said locking arrangement and said removable primary lock.

63. A lock arrangement as set forth in claim 62, wherein:

said primary lock comprises a key lock, having a tumbler cylinder rotatable between open and closed positions.

64. A lock arrangement as set forth in claim 63, wherein:

said mechanical connecting means includes at least one lock slide slidably mounted in said channel, and means for connecting said lock slide with said tumbler cylinder, whereby rotation of said tumbler cylinder reciprocates said lock slide.

65. A lock arrangement as set forth in claim 64, wherein said lock slide connecting means further comprises:

a cam arm detachably attached to and rotating with said tumbler cylinder;

an actuator arm having a first end pivotally connected with said crank arm at a first pivot point, and a second end pivotally connected with said lock slide at a second pivot point, whereby rotation of said tumbler cylinder reciprocates said lock slide.

66. A lock arrangement as set forth in claim 65, wherein:

said first and second pivot points assume an over-centered relationship with respect to the axis of rotation of said tumbler cylinder in the locked position, whereby external forces applied to said lock slide in a direction to force said lock arrangement unlocked, rotably urge said tumbler cylinder further toward the locked position.

67. A lock arrangement as set forth in claim 62, wherein:

said channel includes opposite ends, with first and second channel portions defined therebetween.

68. A lock arrangement as set forth in claim 67, wherein said removable cover has a multiple-piece construction comprising:

a first cover shaped to enclose the first portion of said channel;

first slide latch means connected with said first cover;

second slide latch means connected with the first portion of said channel, and mating with said first slide latch means, whereby said first cover is positioned over the first portion of said channel and translated longitudinally toward one of the channel ends into a locked position, wherein said first and second slide latch means are engaged and prevent downward removal of said first cover from said channel;

a second cover shaped to enclose the second portion of said channel; said second cover being shaped to be vertically inserted between and abut an interior end of said first cover and the other end of said channel to prevent longitudinal translation of said first cover from the locked position; and wherein said cover locking means selectively retains said second cover between said first cover and the other end of said channel.

69. A lock arrangement as set forth in claim 68, wherein:

said second cover is positioned adjacent to said primary lock, whereby removal of said second cover provides direct access to said primary lock.

70. A lock arrangement as set forth in claim 69, wherein said second cover locking means further includes:

third slide latch means connected with said second cover member;

fourth slide latch means connected with the second portion of said channel, and mating with said third slide latch means, whereby fore-to-aft translation of said second cover engages the third and fourth slide latch means into a locked position, and prevents downward removal of said second cover; and means for selectively retaining said second cover in the locked position.

71. A lock arrangement as set forth in claim 70, wherein:

said mechanical connecting means includes at least one lock slide slidably mounted in said channel, and means for connecting said lock slide with said tumbler cylinder, whereby rotation of said tumbler cylinder reciprocates said lock slide.

72. A lock arrangement as set forth in claim 71, wherein:

said second cover member includes a stop on an interior side thereon shaped for mating engagement with a mating portion of said lock slide, whereby shifting said primary lock into the locked position engaged said lock slide with said stop to retain said second cover member in the locked position.

73. A lock arrangement as set forth in claim 72, wherein:

said first slide latch means comprises a plurality of hook-shaped hangers disposed along both sides of said first cover; said hangers having prongs which are mutually parallel, extend in the longitudinal direction of said first cover, and have free ends oriented toward the one end of said channel; and said second slide latch means comprises a plurality of slots disposed in end walls of said channel, and positioned for closely receiving said hanger prongs therethrough.

74. A lock arrangement as set forth in claim 73, wherein:

said third slide latch means includes at least two hook-shaped hangers disposed adjacent opposite sides of said second cover at a rearward portion thereof; said hangers having prongs which are mutually parallel, extend in the longitudinal direction of said second cover, and have free ends oriented toward a forward portion of said second cover; and said fourth slide latch means includes mating slots in interior ends of said first cover and said other channel end, extending in the fore-to-aft direction, and positioned for closely receiving said second cover hanger prongs therethrough.

75. A lock arrangement for office furniture units such as desks, credenzas, and the like, that include at least one closable compartment, such as a drawer, a cabinet or the like, with means for locking said compartment closed, and a top extending the length of said unit, said lock arrangement comprising:

a primary lock mounted in said unit adjacent said top, and having locked and unlocked positions;

a channel opening downwardly from a lower surface of said top, with opposite ends thereof defined by end walls; said primary lock having a portion thereof communicated with the interior of said channel;

means for mechanically connecting said primary lock with said compartment locking means, whereby shifting said primary lock between the locked and unlocked positions locks and unlocks sid compartment; said connecting means being positioned within said channel;

a removable cover assembly having at least a two-piece construction, comprising:

a first cover shaped to enclose one end of said channel;

first slide latch means connected with said first cover;

second slide latch means connected with said channel, and mating with said first slide latch means, whereby said first cover is positioned over the one end of said channel and translated longitudinally into a locked position, wherein said first and second slide latch means are engaged and prevent downward removal of said first cover from said channel;

a second cover shaped to enclose the other end of said channel; said second cover being shaped to be vertically inserted between and abut the interior end of said first cover and the adjacent end wall of said channel to prevent longitudinal translation of said first cover from the locked position; and means for locking said second cover in place between said first cover and the adjacent end wall of said channel to permit only authorized access to said locking arrangement.

* * * * *

UNITED STATES PATENT AND TRADEMARK OFFICE

CERTIFICATE OF CORRECTION

PATENT NO. : 4,457,569

DATED : July 3, 1984

INVENTOR(S) : Douglas Scheerhorn

It is certified that error appears in the above-identified patent and that said Letters Patent is hereby corrected as shown below:

Column 2, line 29:
"prvent" should be --prevent--;

Column 2, line 35:
"accesss" should be --access--;

Column 2, line 62:
"arrangment" should be --arrangement--;

Column 3, line 43:
"bottom" should be --top--;

Column 4, line 36:
"aesthetically pleasing" should be --aesthetically pleasing--;

Column 8, line 15:
"hanger" should be --hangers--;

Column 9, line 18:
"reciprocaton" should be --reciprocation--;

Column 9, line 25:
"145" should be --161--;

Column 9, line 27:
"145" should be --161--;

Column 13, line 17:
"members" should be --member--;

UNITED STATES PATENT AND TRADEMARK OFFICE

CERTIFICATE OF CORRECTION

PATENT NO. : 4,457,569

DATED : July 3, 1984

INVENTOR(S) : Douglas Scheerhorn

It is certified that error appears in the above-identified patent and that said Letters Patent is hereby corrected as shown below:

Column 15, line 4:

"arrangment" should be --arrangement--;

Column 18, line 29:

"rotably" should be --rotatably--;

Column 19, line 22:

"engaged" should be --engages--;

Column 20, line 19:

"sid" should be --said--.

Signed and Sealed this

*Ninth* Day of *April 1985*

[SEAL]

*Attest:*

DONALD J. QUIGG

*Attesting Officer* *Acting Commissioner of Patents and Trademarks*